US008355654B2

(12) United States Patent
Izawa et al.

(10) Patent No.: US 8,355,654 B2
(45) Date of Patent: Jan. 15, 2013

(54) WET TYPE ELECTROPHOTOGRAPHIC PRINTER COMPRISING A CARRIER LIQUID REMOVING UNIT

(75) Inventors: Hideo Izawa, Narashino (JP); Junichi Setoyama, Narashino (JP); Kotaro Harada, Narashino (JP); Sumito Mera, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 312 days.

(21) Appl. No.: 12/763,891

(22) Filed: Apr. 20, 2010

(65) Prior Publication Data

US 2010/0284709 A1 Nov. 11, 2010

(30) Foreign Application Priority Data

May 8, 2009 (JP) ..... 2009-113507

(51) Int. Cl.
*G03G 15/10* (2006.01)

(52) U.S. Cl. ..... 399/249; 399/241

(58) Field of Classification Search ..... 399/249, 399/241

See application file for complete search history.

(56) References Cited

U.S. PATENT DOCUMENTS

| | | | | |
|---|---|---|---|---|
| 3,955,533 | A * | 5/1976 | Smith et al. | 399/249 |
| 5,815,779 | A * | 9/1998 | Abramsohn | 399/249 |
| 6,085,054 | A | 7/2000 | Kusayanagi | |
| 6,215,973 | B1 | 4/2001 | Shin | |
| 6,735,408 | B2 * | 5/2004 | Yoshino et al. | |
| 6,738,592 | B2 * | 5/2004 | Sasaki et al. | |
| 2003/0161658 | A1 * | 8/2003 | Park | |

FOREIGN PATENT DOCUMENTS

| | | |
|---|---|---|
| JP | 57-049971 | 3/1982 |
| JP | 1-43307 | 9/1989 |
| JP | 2005-134631 | 5/2005 |

* cited by examiner

*Primary Examiner* — David Gray
*Assistant Examiner* — Laura Roth
(74) *Attorney, Agent, or Firm* — Cozen O'Connor

(57) ABSTRACT

To remove a surplus carrier liquid after development on the surface of a photoconductor drum to obtain homogeneous printed images without being affected by an error in rotational accuracy of such as a carrier liquid removing roller, there is provided a wet type electrophotographic printer in which the carrier liquid removing roller 14 of a carrier liquid removing unit 8 is caused to come in rotational contact with the photoconductor drum 1 to remove a carrier liquid from the liquid toner image, thereby making a toner image for transfer onto a recording medium 7, the wet type electrophotographic printer being so configured that the carrier liquid removing roller in rotational contact with the photoconductor drum is urged against the latter under an urging force made adjustable; and a scraping blade 23 is brought into contact with the carrier liquid removing roller while being urged against the latter under an urging force made adjustable.

4 Claims, 3 Drawing Sheets

WET TYPE ELECTROPHOTOGRAPHIC PRINTER COMPRISING A CARRIER LIQUID REMOVING UNIT

TECHNICAL FIELD

The present invention relates to a wet type electrophotographic printer and in particular to a wet type electrophotographic printer provided with a carrier liquid removing unit for removing an excessive amount of carrier liquid from the surface of a photoconductor drum on which an electrostatic latent image is developed with a liquid toner comprising the carrier liquid and toner particles.

BACKGROUND ART

The carrier liquid removing unit in the wet type electrographic printer is disposed downstream of a developing unit in the rotary direction of the photoconductor drum. With its carrier liquid removing roller placed with a given spacing from or in pressure contact with the peripheral surface of the photoconductor drum, the carrier liquid removing roller is rotated so that its peripheral surface moves in an identical direction in which the peripheral surface of the photoconductor drum moves, to remove an excessive carrier liquid of the liquid toner supplied onto the photoconductor drum surface in the developing unit, thereby making proper the toner density of the liquid toner supplied onto the photoconductor drum surface.

The axial distance between the carrier liquid removing roller and the photoconductor drum must be kept constant at a given distance to keep proper the gapping space or nip pressure between the carrier liquid removing roller surface and the photoconductor drum surface.

The carrier liquid removing roller so far used in a carrier liquid removing unit of this sort is provided at its opposite axial ends with auxiliary rollers coaxially which are rotated in contact with the peripheral surface of the photoconductor drum while being spring biased to set positioning of the carrier liquid removing roller relative to the photoconductor drum (see JP H01-43307 B).

In the conventional carrier liquid removing unit mentioned above, for the convenience of maintaining the proximity at a fixed distance of the carrier liquid removing roller from the photoconductor drum, there exist problems that their respective contacting surfaces which need to be of a certain hardness wear as they contact and with the progress of such wear the accuracy of the proximity at the fixed distance may deteriorate, that its manufacturing cost increases due to the need for its high-precision components and an increase of the necessary parts and that the influences of deterioration in rotational accuracy and surface state of the carrier liquid removing roller sides cannot be eliminated. Besides, problems likewise arise if there is an imperfect manufacturing accuracy such as a runout of the rollers themselves.

Made to resolve these problems, the present invention has as of its objects to provide a wet type electrophotographic printer whereby an excessive carrier liquid subsequent to development on the surface of a photoconductive drum can be removed to obtain homogeneous images, without being affected by an error in rotational accuracy caused in assembling such as carrier liquid removing roller and so forth in the manufacture and/or by their changes with time.

SUMMARY OF THE INVENTION

In order to achieve the object mentioned above, there is provided in accordance with the present invention in a first aspect thereof a wet type electrophotographic printer in which an electrostatic latent image formed on a photoconductor drum is developed into a liquid toner image by a developing unit using a liquid toner and then a carrier liquid removing roller of a carrier liquid removing unit is caused to come in rotational contact with the photoconductor drum to remove a carrier liquid from the liquid toner image, thereby making a toner image for transfer onto a recording medium, wherein the wet type electrophotographic printer is so configured that the carrier liquid removing roller in rotational contact with the photoconductor drum is urged against the latter under an urging force made adjustable; and a scraping blade is brought into contact with the carrier liquid removing roller while being urged against the latter under an urging force made adjustable.

In a second aspect of the present invention, a wet type electrophotographic printer as mentioned above includes a cassette frame supporting the carrier liquid removing roller and the scraping blade of the carrier liquid removing unit and supported by a supporting frame so that it can be slidably moved in a direction parallel to the shaft of the photoconductor drum, wherein the supporting frame is movable in directions in which the carrier liquid removing roller is brought into contact with and away from the photoconductor drum and the scraping blade is capable of being brought into contact with and away from the carrier liquid removing roller. Further, in a third aspect of the present invention, a wet type electrophotographic printer as mentioned above includes a set charger disposed between the developing unit and the carrier liquid removing unit so as to apply a voltage to move toner of the liquid toner image on the photoconductor drum towards a surface of the photoconductor drum.

According to the first aspect of the present invention, causing the carrier liquid removing roller of the carrier liquid removing unit to come in rotational contact with the surface of the photoconductor drum while being urged against the latter under an urging force made adjustable allows the pressure of contact between the photoconductor drum and the carrier liquid removing roller to be held always proper to obtain homogeneous printed images stably, even if there exists an error in rotational accuracy caused in assembling in manufacture of the photoconductor drum, the carrier liquid removing roll and the like or brought about by their changes with time. Also, while influences from the error in accuracy appear noticeably with an increase in printing speed, the invention enables stably printed images with enhanced printing quality and productivity even with a traveling speed of the recording medium, namely its printing speed of as high as 60 m/min.

Also, causing the scraping blade to contact the carrier liquid removing roller while being urged against the latter under the urging force made adjustable in the first aspect of the invention allows achieving stabilization of the pressure of contact between the carrier liquid removing roller and the scraping blade.

Further, according to the first aspect of the invention made up as mentioned above, consumable parts are reduced and a proper contact pressure can be maintained with parts simply configured. And, it is also possible to preserve a stabilized working state for an extended time period, to increase the productivity and to achieve large effects in economy in respect of the production cost.

Further, while the cost for maintaining the photoconductor drum, the carrier liquid removing roller and the like at precision has so far largely determined the total cost, the economical effect is also obtained that the cost for their maintenance is reduced.

According to the second aspect of the present invention, the carrier liquid removing roller and the scraping blade for contact therewith are made capable of being taken in and out together with the cassette frame. This improves their inspection-serviceability and facilitates maintaining them in a proper state.

Besides, during a standstill of the printer, the carrier liquid removing roller and the scraping blade can be held apart from the photoconductor drum and the carrier liquid removing roller, respectively, to prevent them from getting permanent deformation due to their contact at halts.

Further, according to the third aspect of the present invention, the combined use of a set charger allows preserving a printing quality that is high in density and stable.

BEST MODES FOR CARRYING OUT THE INVENTION

Figure 1:
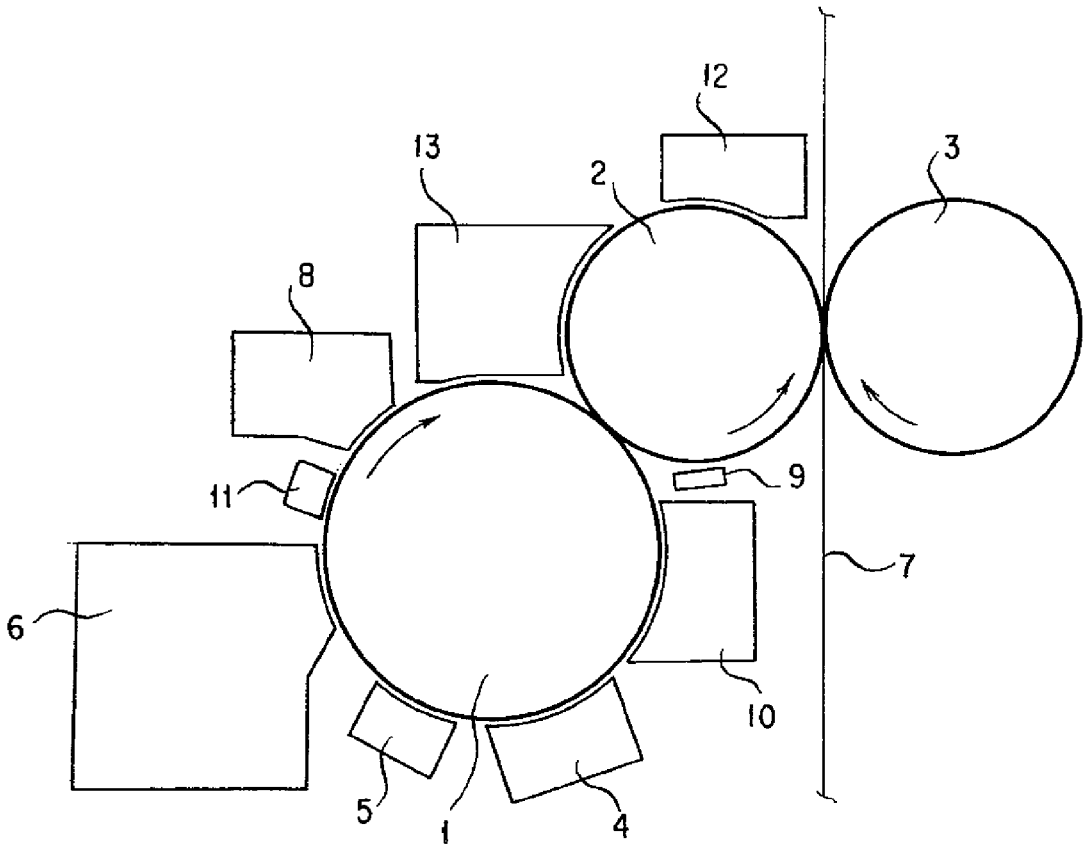
FIG. 1 is an explanatory view diagrammatically illustrating the makeup of a wet type electrophotographic printer.

FIG. 1 is an explanatory view which diagrammatically illustrates the makeup of an electrophotographic printer for carrying out the present invention. As shown, a photoconductor drum 1 is in rotational contact with a transfer drum 2 which in turn is in rotational contact with a backup roll 3.

In such a wet type electrophotographic printer, the photoconductor drum 1 when in image formation thereon is rotated by a drive means such as a motor (not shown) at a fixed speed in a direction of the arrow. The surface of the photoconductor drum 1 is charged uniformly in the dark by a charging unit 4 and then an original light figure is irradiated and imaged thereon by an exposure unit 5, whereby an electrostatic latent image is formed on the surface of the photoconductor drum 1. Thereafter, the electrostatic latent image when passing through its developing region is visualized by a developing unit 6 with a liquid toner into a liquid toner image, forming a toner image on the surface of the photoconductor drum 1.

The toner image on the surface of the photoconductor drum 1 is primarily transferred onto a surface of the transfer roller 2 in its primary transfer region under a bias voltage applied via the transfer roller 2 and a nip pressure between the photoconductor drum 1 and the transfer roller 2. This primarily transferred toner image is secondarily transferred in its secondary transfer region on a recording medium 7 passing between the transfer drum 2 and the backup roller 3. The transfer roller 2 has its peripheral surface covered with an electrically conductive and elastomeric material.

Provided also around the circumference of the photoconductor drum 1 are a carrier liquid removing unit 8, a charge eliminator 9, a photoconductor drum cleaning device 10 and a set charger 11. The carrier liquid removing unit 8 is disposed downstream of the position of the developing unit 6 in the direction of rotation of the photoconductor drum 1 for removing a portion (surplusage) of a carrier liquid of the liquid toner image after development. The charge eliminator 9 is disposed downstream of the area where the photoconductor drum 1 is in rotational contact with the transfer roller 2 for removing a residual potential residual on the photoconductor drum 1 after the primary image transfer onto the transfer roller 2. The photoconductor drum cleaning device 10 acts to remove a residual toner residual on the surface of the photoconductor drum 1. And, the set charger 11 is disposed between the developing unit 6 and the carrier liquid removing unit 8 for applying a bias voltage to the toner of the liquid toner image on the surface of the photoconductor drum 1.

Also, provided around the transfer roller 2 are a carrier liquid supply unit 12 and a transfer roller cleaning device 13. The carrier liquid supply unit 12 and the transfer roller cleaning device 13 are disposed downstream of the area where the transfer roller 2 is in rotational contact with the backup roller 3 in its direction of rotation and between that area and the area where the transfer roller 2 is in rotational contact with the photoconductor drum 1 in order from its upstream side. The carrier liquid supply unit 12 acts to supply the carrier liquid onto the transfer roller 2 after the secondary image transfer, and the transfer roller cleaning device 13 serves to clean the surface of the transfer roller 2. And, this cleaning device 13 is disposed spaced at a given distance from the carrier liquid supply unit 12, e.g., at a distance that is equal to ¼ of the peripheral length of the transfer roller 2.

Figure 2:
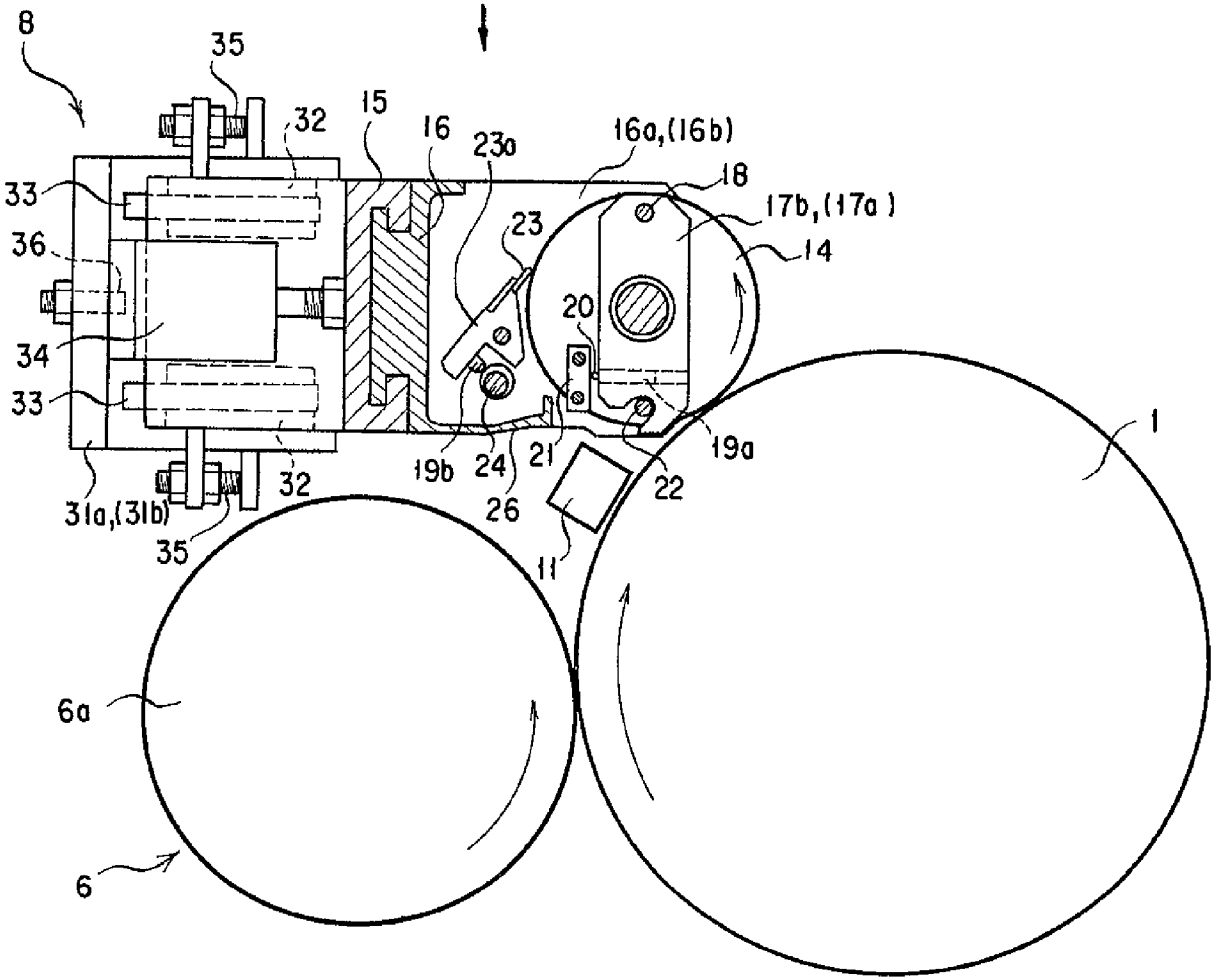
FIG. 2 is an explanatory view illustrating the makeup of an essential part of the present invention.
Figure 3:
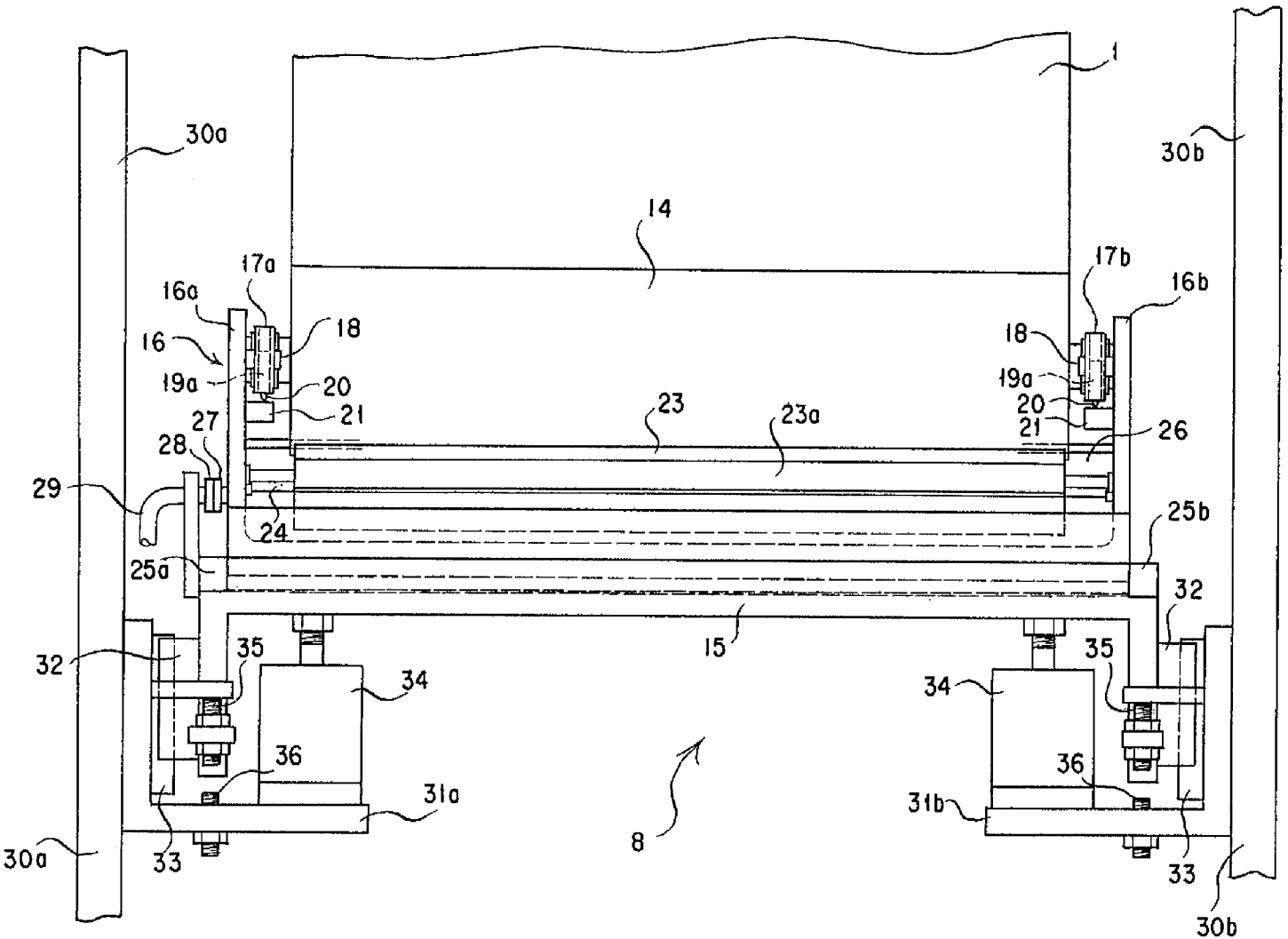
FIG. 3 is an explanatory view illustrating the makeup of the essential part as seen from the direction indicated by the arrow A in FIG. 2.

An explanation is next given of the makeup of an essential part of the carrier liquid removing unit 8, referring to FIGS. 2 and 3 which diagrammatically illustrate the same. FIG. 2 is a cross sectional view in part broken and FIG. 3 is a sectional view as seen in the direction of arrow A in FIG. 2.

Reference numeral 14 in the Figures indicates a carrier liquid removing roller brought in rotational contact with the peripheral surface of the photoconductor drum 1 and driven to rotate following its rotation in the forward direction. The carrier liquid removing roller 14 is supported by a cassette frame 16 supported by a frame 15 so as to be slidably movable axially or parallel to an axial direction, of the photoconductor drum 1 and is at the same time urged by spring means against the peripheral surface of the photoconductor drum 1. The supporting frame 15 and the cassette frame 16 are coupled together in a rail type mechanism (sliding mechanism) so that the cassette frame 16 can be slidably moved relative to the supporting frame 15. Parenthetically, an auxiliary roller may be interposed in an area of their coupling of the rail type to reduce their sliding resistance.

The surface of the carrier liquid removing roller 14 is made of an electrically conductive rubber and has a bias voltage applied thereto which is identical in polarity to the toner of the liquid toner to repel the toner.

The cassette frame 16 has a pair of brackets 16*a* and 16*b* at opposed sides axially of the carrier liquid removing roller 14. On the insides of each bracket 16*a*, 16*b*, a bearing lever 17*a*, 17*b* is rotatably supported on through a rotary fulcrum 18. By these bearing levers 17*a* and 17*b*, the carrier liquid removing roller 14 is rotatably supported at its opposed ends. The rotary fulcrum 18 on the bearing levers 17*a* and 17*b* is provided at their end side which relative to the center of rotation of the carrier liquid removing roller 14 is remote from its rotational contacting point with the photoconductor drum 1 whereby rotation of the bearing levers 17*a* and 17*b* centering on the rotary fulcrum 18 causes the peripheral surface of the carrier liquid removing roller 14 to be displaced in directions in which it is brought into contact with and away from the photoconductor drum 1.

The bearing lever 17*a*, 17*b* is provided with a spring plunger 19*a* which has an internal coil spring acting in a direction parallel to its tangential direction and has a working end 20 that acts in a direction in which it becomes remote from the photoconductor drum 1. And, a supporting member 21 with which the working end 20 is in contact is fastened to the bracket 16*a*, 16*b*. With the working end 20 in contact with the supporting member 21, the bearing lever 17*a*, 17*b*, hence the carrier liquid removing roller 14, is spring biased, or urged, towards the photoconductor drum 1. The spring plunger 19*a* as a male screw is screwed with the bearing lever 17*a*, 17*b*. By rotating the spring plunger 19*a* with a screwdriver or the like to axially advance or retract it, it is made possible for the force of urging towards the photoconductor drum 1 to be adjusted at the working end 20.

The bearing lever 17*a*, 17*b* is provided at its forward end with a yoke in which a stopper pin 22 fastened to the bracket 16*a*, 16*b* is freely fitted with a play. With such a play, the range of rotation of the bearing lever 17*a*, 17*b* relative to the bracket 16*a*, 16*b*, hence the range of movement of the carrier liquid removing roller 14 relative to the photoconductor drum 1 in their rotational contacting direction can be controlled.

Inside of the cassette frame 16 there is provided a scraping blade 23 come in contact with the peripheral surface of the carrier liquid removing roller 14 in a direction opposite to its rotary direction. The scraping blade 23 extends longitudinally and is supported by a bracket 23*a* mounted rotatably. And, each bracket 23*a* is spring biased, or urged, by a spring plunger 19*b* in a direction in which the forward end of the blade comes in contact with the carrier liquid removing roller 14. The spring plunger 19*b* has a working end (tip) coming in contact with an eccentric cam 24. Rotating the eccentric cam 24 displaces the working end, thus making it possible for the force of urging by the spring plunger 19*b* to be adjusted. Parenthetically, note that alternatively the spring plunger 19*b* can be rotated with a screwdriver or the like to adjust the force of urging. The eccentric cam 24 can be rotated by a predetermined angle or more to separate the scraping blade 23 from the carrier liquid removing roller 14.

The cassette frame 16 as mentioned above is supported by the supporting frame 15 so that it can be slidably moved in a direction parallel to the shaft of the photoconductor drum 1. This makes it possible to dismount the entire cassette frame 16 from the supporting frame 15. And, at opposed sides in its fitting direction there are disposed positioning plates 25*a* and 25*b* of which the positioning plate 25 at the backside is brought into contact with one end of the cassette frame 16 and the positioning plate 25*b* at the foreside is brought into contact with its other end to enable positioning of the cassette frame 16 in its inserting direction.

Also, the cassette frame 16 is provided in its lower part with a liquid pool 26 formed in a shape of trough, and in the bracket 16*a* at the backside with one coupler 27 in communication with the liquid pool 26. On the other hand, the supporting frame 15 is provided with the other coupler 28 which establishes the communication by being pushed against the coupler 27. The couplers 27 and 28 are pushed against each other to communicate with each other when the cassette frame 16 is in its set state, and thereby liquid in the liquid pool 26 is discharged from a liquid recovery duct 29 via the couplers 27 and 28.

The supporting frame 15 has its opposed ends supported via slide guides 32 and 33 by fixed brackets 31*a* and 31*b* fastened to a left and a right hand side frame 30*a* and 30*b*, respectively, so that it can be moved in directions in which the carrier liquid removing roller 14 is brought into contact with and away from the photoconductor drum 1. And, between the supporting frame 15 and the fixed bracket 31*a*, 31*b* there is arranged an air cylinder 34, 34 so that its base is supported by the fixed bracket 31*a*, 31*b* and its piston rod is screwed into the supporting frame 15 whereby extending the piston rods of the air cylinders 34 and 34 synchronously advances the carrier liquid removing roller 14 to a point at which it comes in contact with the photoconductor 1 and retracting them retracts it to a position at which it is largely apart from the photoconductor drum 1.

In FIGS. 2 and 3, Reference numerals 35 and 36 indicate a stopper to regulate advancing of and a stopper to regulate retracting of the supporting frame 15, respectively. Their respective stopper positions are made adjustable each by varying the position with a screw. Positioning the advancing stopper 35 can alternatively be achieved by adjusting the stroke end of the air cylinder 34, 34. The adjustment of the stroke end in this case can be made by length adjustment by screwing the piston rod.

Mention is next made of an operation of the carrier liquid removing unit made up as described above.

The carrier liquid removing roller 14 is pressed on and brought into rotational contact with the peripheral surface of the photoconductor drum 1 by the spring plunger 19*a* under a predetermined force of urging and is driven to rotate following rotation of the photoconductor drum 1 in an identical peripheral direction whereby a surplus carrier liquid in the liquid toner image developed on the surface of the photoconductor drum 1 by the developing roller 6*a* of the developing unit 6 is removed by adhering on the surface of carrier liquid removing roller 14.

Then, as a bias voltage which is identical in polarity to the toner of the liquid toner is applied to the carrier liquid removing roller 14, the toner of the liquid toner is pressed on the surface of the photoconductor drum 1 with the result that mainly the carrier liquid comes to adhere on the roller surface of the carrier liquid removing roller 14.

The force under which the carrier liquid removing roll 14 is urged against the photoconductor drum 1 is made variable by adjustment of the spring plunger 19*a*. Thus, even if there exists a runout of the roller due to a distortion of the photoconductor drum 1, changes with time of the accuracy of the carrier liquid removing roller 14 and its diameter, and its assembling inaccuracy, the contact pressure at a point of its contact with the photoconductor drum can be held always constant.

The carrier liquid adhering on the carrier liquid removing roller 14 is scraped off by the scraping blade 23, stored in the liquid pool 26 of the cassette frame 16 and then discharged therefrom passing through the couplers 27 and 28 and the liquid recovery duct 29.

The scraping blade 23 is then pressed under a biasing or urging force by the spring plunger 19*b* on the surface of the carrier liquid removing roller 14. The pressing force is then adjusted by adjusting the urging force by the spring plunger 19*b*. If a runout of the photoconductor drum and a runout of the carrier liquid removing roller 14 exist, amounts of such runout may be overlapped to influence on the pressure of contact between the scraping blade 23 and the carrier liquid removing roller 14, but such influence is absorbed by the spring plunger 19*b* to allow the contact pressure to be held constant by the spring plunger 19*b*. The result is the achievement of an improved carrier liquid removal (recovery) made always stable. It can also absorb individual differences in the scraping blade 23 as regards its torsion and the like and facilitates adjusting the blade contact pressure.

Further, the carrier liquid removing roller 14 is moved between a position at which it is in rotational contact with the photoconductor drum 1 and a position at which it is apart from the photoconductor drum 1, by an extending and retracting operation by the piston rod of the air cylinder 34, 34. And, holding the carrier liquid removing roller 14 apart from the photoconductor drum 1 during a standstill of the printer makes it possible to prevent a permanent deformation from occurring in the carrier liquid removing roller 14 when it comes to a stop. Also, at the stop, the eccentric cam 24 supporting the spring plunger 19*b* that is urging the scraping blade 24 can be largely rotated to separate the tip of the scraping blade 23 from the carrier liquid removing roller 14, thereby preventing a permanent deformation of the carrier liquid removing roller 14 due to its contact with the scraping blade 23.

Further, in the state that the carrier liquid removing roller 14 is apart from the photoconductor drum 1 by retracting the piston rod of the air cylinder 34, the foreside positioning plate 25*b* can be removed to remove the cassette frame 16 from the fixing frame 15 and thereby to take the entire cassette frame 16 out of the apparatus. In this state, maintenance operations for parts in the cassette frame 16 such as the carrier liquid removing roller 14 can be performed. Moreover, the communication and its interruption between the liquid pool 26 in the cassette frame 16 and the liquid recovery duct 29 are then made automatically by the couplers which are coupled and decoupled as the cassette frame 16 is inserted and removed.

In a wet type electrophotographic printer with a carrier liquid removing unit 8 acting as mentioned above, a liquid toner image developed and visualized with a liquid toner by a developing unit 6 from an electrostatic latent image formed on a photoconductor drum 1 has a bias voltage applied to toner by a set charger 11 immediately after the development to separate the toner in the visualized image from the carrier liquid, the toner in its densified state being attracted towards the photoconductor drum 1.

Accordingly, in the carrier liquid removing unit 8 disposed downstream of the set charger 11, the carrier liquid removing roller 14 is pressed against the liquid toner in which the toner is attracted by the set charger 11 towards the photoconductor drum 1, to ensure that the liquid toner after the development is pressed on the photoconductor drum 1 in the densified state by the carrier liquid removing unit 8.

While in the form of implementation of the invention described hereinbefore for a wet type electrophotographic printer, a toner image on a photoconductor drum 1 as illustrated is transferred via a transfer roller 2 onto a recording medium 7, the present invention may be applied to a wet type electrophotographic printer in which a recording medium 7 is run along the photoconductor drum 1 to acquire a direct transfer therefrom.

What is claimed is:

1. A wet type electrophotographic printer, comprising:

a photoconductor drum;

an electrostatic latent image formed on the photoconductor drum and developed into a liquid toner image by a developing unit using a liquid toner;

a carrier liquid removing unit including a carrier liquid removing roller, the carrier liquid removing roller of the carrier liquid removing unit being mounted for movement into rotational contact with the photoconductor drum to remove a carrier liquid from the liquid toner image and create a toner image for transfer onto a recording medium;

a first spring plunger having an adjustable urging force for urging the carrier liquid removing roller into rotational contact against the photoconductor drum;

a second spring plunger having a second adjustable urging force; and a scraping blade which is movable into contact with the carrier liquid removing roller while being urged against the carrier liquid removing roller by the second adjustable urging force of the second spring plunger.

2. The wet type electrophotographic printer as set forth in claim 1, further comprising:

a cassette frame supporting the carrier liquid removing roller and the scraping blade of the carrier liquid removing unit and supported by a supporting frame so that the cassette frame is slidably movable in a direction parallel to a shaft of the photoconductor drum;

wherein said supporting frame is movable in directions in which the carrier liquid removing roller is movable into contact with and away from the photoconductor drum and said scraping blade is movable into contact with and away from the carrier liquid removing roller.

3. The wet type electrophotographic printer as set forth in claim 2, further comprising:

a set charger disposed between the developing unit and the carrier liquid removing unit so as to apply a voltage to move toner of the liquid toner image on the photoconductor drum towards a surface of the photoconductor drum.

4. The wet type electrophotographic printer as set forth in claim 1, further comprising:

a set charger disposed between the developing unit and the carrier liquid removing unit so as to apply a voltage to move toner of the liquid toner image on the photoconductor drum towards a surface of the photoconductor drum.

* * * * *